US007958940B2

(12) United States Patent
Jameson

(10) Patent No.: US 7,958,940 B2
(45) Date of Patent: Jun. 14, 2011

(54) METHOD AND APPARATUS TO REMOVE COMPOSITE FRAC PLUGS FROM CASINGS IN OIL AND GAS WELLS

(76) Inventor: Steve D. Jameson, Weed, NM (US)

( * ) Notice: Subject to any disclaimer, the term of this patent is extended or adjusted under 35 U.S.C. 154(b) by 0 days.

(21) Appl. No.: 12/384,024

(22) Filed: Mar. 31, 2009

(65) Prior Publication Data

US 2010/0000741 A1 Jan. 7, 2010

Related U.S. Application Data

(63) Continuation-in-part of application No. 12/217,238, filed on Jul. 2, 2008, now abandoned.

(51) Int. Cl.
*E21B 29/00* (2006.01)

(52) U.S. Cl. ..... 166/376; 166/55.6; 175/398; 175/428

(58) Field of Classification Search ..... 166/376, 166/298, 55.6, 55.7
See application file for complete search history.

(56) References Cited

U.S. PATENT DOCUMENTS

| | | | | |
|---|---|---|---|---|
| 3,760,894 | A * | 9/1973 | Pitifer | 175/413 |
| 5,147,001 | A * | 9/1992 | Chow et al. | 175/428 |
| 5,199,513 | A * | 4/1993 | Stewart et al. | 175/73 |
| 5,456,312 | A * | 10/1995 | Lynde et al. | 166/55.6 |
| 5,887,668 | A * | 3/1999 | Haugen et al. | 175/79 |
| 6,491,116 | B2 * | 12/2002 | Berscheidt et al. | 175/57 |
| 6,715,567 | B2 * | 4/2004 | Delgado et al. | 175/61 |
| 7,255,178 | B2 * | 8/2007 | Slup et al. | 166/386 |
| 7,325,631 | B2 * | 2/2008 | Roberts et al. | 175/300 |
| 2008/0173453 | A1 * | 7/2008 | Misselbrook | 166/311 |

* cited by examiner

*Primary Examiner* — David J Bagnell
*Assistant Examiner* — Elizabeth C Gottlieb
(74) *Attorney, Agent, or Firm* — Tod R. Nissle, P.C.

(57) ABSTRACT

A process is provided to drill through a composite frac plug. The plug is in an oil well. The process utilizes an improved mill. The process also rotates drill pipe at one hundred to five hundred rpm and circulates drilling fluid such that the velocity of the fluid upwardly over the exterior of the drill pipe is in the range of three hundred to four hundred and seventy-five feet per minute. One thousand to three thousand pounds of slack off weight is applied during the process.

1 Claim, 3 Drawing Sheets

FIG. 1
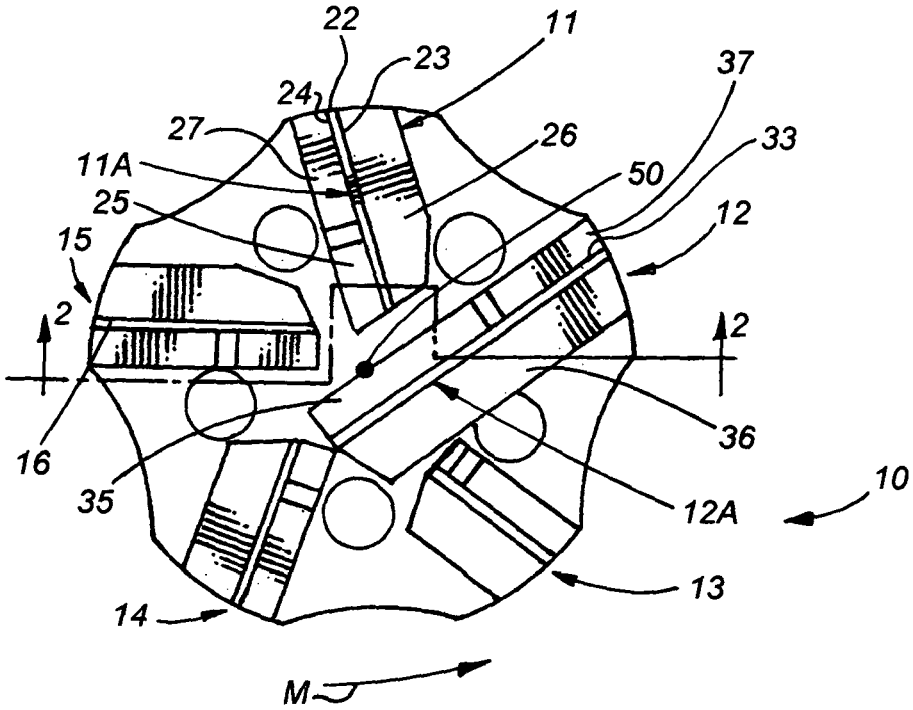
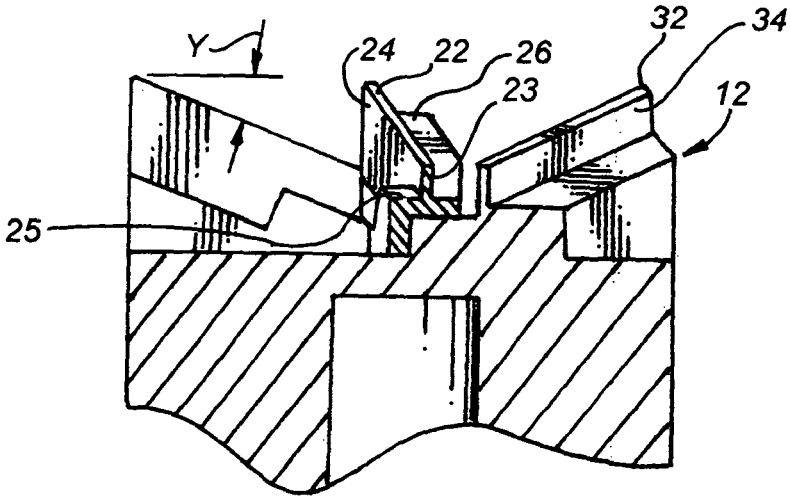
FIG. 2

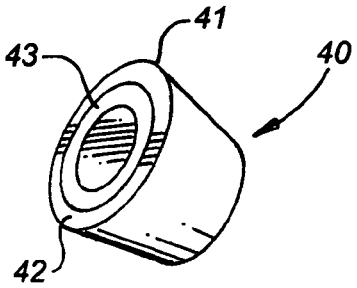
FIG. 3
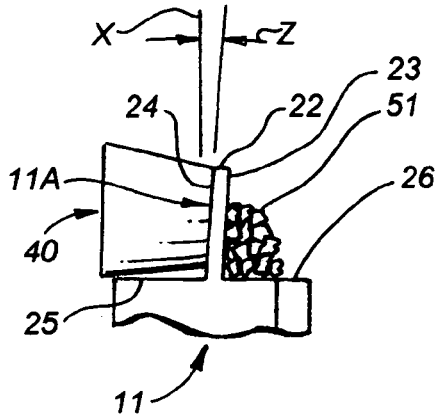
FIG. 4
FIG. 5
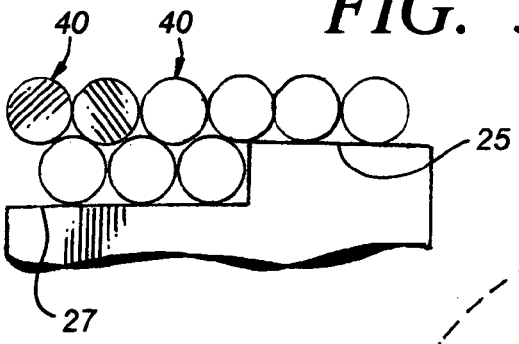
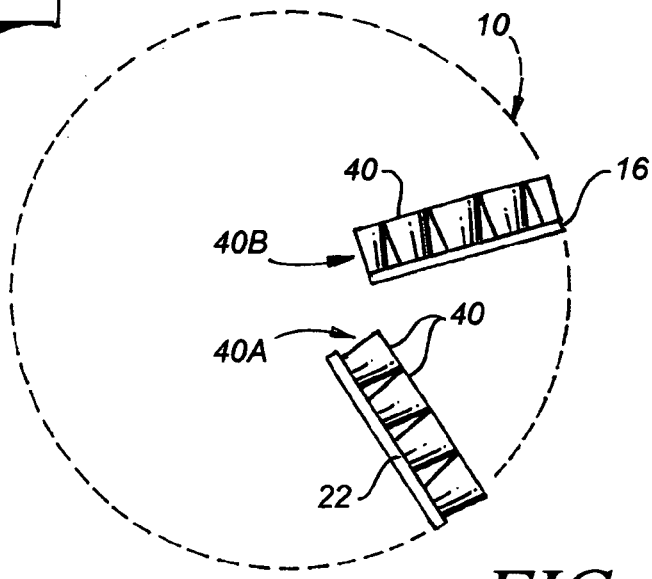
FIG. 6

FIG. 7
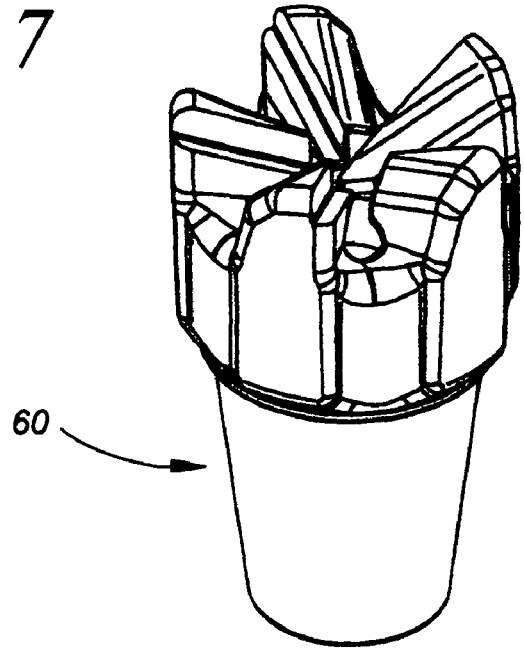
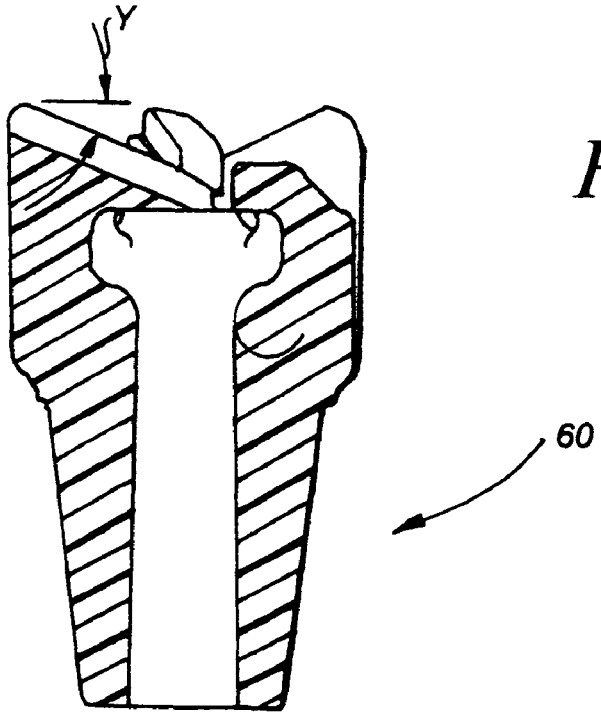
FIG. 8

METHOD AND APPARATUS TO REMOVE COMPOSITE FRAC PLUGS FROM CASINGS IN OIL AND GAS WELLS

CROSS-REFERENCE TO RELATED APPLICATIONS

This application is a continuation-in-part of application Ser. No. 12/217,238, filed Jul. 2, 2008 now abandoned.

STATEMENT REGARDING FEDERALLY SPONSORED RESEARCH OR DEVELOPMENT

Not Applicable.

THE NAMES OF PARTIES TO A JOINT RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION (1) Field of the Invention

This invention pertains to a system to remove frac plugs in a well.

(2) Description of Related Art Including Information Disclosed Under 37 CFR 1.97 and 1.98

Oil or gas wells often have in the ground multiple formations. When there is a need to fracture individually these formations to stimulate them to better produce oil, temporary plugging agents or "frac plugs" are set at desired elevations in the well casing or bore to facilitate fracturing the formations in stages. After each desired formation has been fractured, the frac plugs are removed to enable operation of the well to produce oil or gas. Frac is a shorthand term for fracturing in connection with oil and gas wells.

Composite frac plugs are often utilized. These frac plugs include or incorporate a resin in combination with a ceramic, cloth, aluminum, cast iron and/or some other material. For example, one frac plug includes a resin body in combination with an aluminum mandrel and cast iron slips. Still another frac plug includes a resin body in combination with ceramic inserts. Some examples of commonly used composite frac plugs include the MILL EZ™ by Magnum Oil Tools, the SPEEDY LINE II™ by Halliburton, the QUICK DRILL 2™ by Baker Oil Tools, the PYTHON MT™ by BJ Services, the D2™ by Smith Services, and the FRACGUARD™ by Weatherford Completion Systems.

Conventional mills have long been utilized to remove frac plugs, as well as other materials including steel, cast iron, cement, dehydrated drilling mud, and dehydrated sand slurries.

BRIEF DESCRIPTION OF THE SEVERAL VIEWS OF THE DRAWINGS

I have discovered an improved process to remove materials from oil and gas well casings or bores.

This improved process is described with reference to the drawings, in which:

FIG. 1 is a top view illustrating a mill utilized in the system of the invention;

FIG. 2 is a section view of the mill of FIG. 1 illustrating additional construction details thereof;

FIG. 3 is a perspective view illustrating a tapered carbide insert that is welded onto a receiving seat in the mill of FIGS. 1 and 2;

FIG. 4 is an end view taken from the center 50 of the top of the mill of FIG. 1 illustrating a tapered carbide insert in position on a receiving seat in the mill prior to the insert being welded or otherwise secured to the seat;

FIG. 5 is a side view illustrating carbide inserts stacked in position on a pair of stepped receiving seats in the mill of FIGS. 1 and 2;

FIG. 6 is a top view illustrating the offset disposition of carbide inserts on succeeding seats in the mill of FIGS. 1 to 4;

FIG. 7 is a perspective view of a mill 60 of the general type utilized in the method of the invention; and, FIG. 8 is a side section view of the mill 60 of FIG. 7 illustrating additional construction features thereof.

BRIEF SUMMARY OF THE INVENTION

Briefly, in accordance with the invention, I provide an improved process to drill through a composite frac plug in an oil well. The composite frac plug includes a resin in combination with at least one material selected from a group consisting of a ceramic, cast iron, aluminum and cloth. The process includes the steps of providing a mill including a plurality of spaced apart seats, each seat including an upstanding leg canted at an angle from the vertical in the range of eighteen to twenty-six degrees, and a plurality of carbide inserts affixed to each seat and including a peripheral edge extending outwardly from the seat; providing drill pipe having a distal end and a proximate end; attaching the mill to the distal end of the drill pipe; inserting the mill and the distal end of the drill pipe in the oil well until the mill contacts the top of the composite frac plug; rotating the mill at one hundred to five hundred rpm; circulating drilling fluid such that the velocity of said fluid upwardly over said exterior of said drill pipe is in the range of three hundred to four hundred and seventy five feet per minute; and, engaging the proximate end of the drill pipe and applying one thousand to three thousand pounds of slack off weight.

DETAILED DESCRIPTION OF THE INVENTION

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 to 2 illustrate a mill constructed in accordance with the invention and generally indicated by reference character 10. Mill 10 includes a plurality of spaced apart radial insert support structures 11 to 15. In use, mill 10 rotates in the direction indicated by arrow M in FIG. 1.

Insert support structure 11 includes flat (or if desired, convex or concave) ledge 26. A leg 11A outwardly depends from ledge 26 and includes outer edge 22, back surface 23, and front surface 24. When mill 10 is in the upright vertically oriented orientation illustrated in FIGS. 1 to 2, the leg 11A, 12A of each radial seat structure 11 to 15 is tilted or canted back at an angle Z (FIG. 4) from vertical axis X. Axis X is parallel to the axis of rotation of mill 10. Angle Z is one to three degrees, preferably about two degrees, from the vertical axis X. This angle Z is illustrated in FIG. 4 and is exaggerated in the drawings for purposes of illustration. Angle Z is important in the efficient operation of mill 10 because it functions to lessen initial cutting impact, friction and surface tensions, thereby increasing the operational life of the mill.

Inner seat 25 and outer seat 27 are each generally parallel to ledge 26, are each generally normal to surfaces 23 and 24, and each extend inwardly toward the center 50 of mill 10. As is more readily seen in FIG. 5, seat 35 is higher than, or is "stepped" up from, seat 27. Insert support structures 12 to 15 are each generally equivalent in structure to that of insert support structure 11. However, as can be seen in FIGS. 1 and 2, inner seat 35 associated with insert support structure 12 extends further inwardly than do the inner seats 25 associated with the other insert support structures 11, 13 to 15. In fact, inner seat 35 extends inwardly past the center 50 of mill 10.

Insert support structure 12 includes flat ledge 36. A leg 12A outwardly depends from ledge 36 and includes outer edge 32, front surface 33, and back surface 34. Seat 35 is generally perpendicular to surfaces 33 and 34 and, as noted, extends inwardly toward and past the center 50 of mill 10. The elevation of seat 37 is lower than the elevation of seat 35, just as the elevation of seat 27 is lower than the elevation of seat 25.

The stepped seats 25 and 27 of a insert support structure 11 receive a stacked pair of rows of conically shaped carbide inserts or cutters 40. Each insert or cutter 40 can, if desired, include one or more circular concave detents, or "chip breakers", formed in the larger diameter face 42 of an insert or cutter 40 and within the outer circular peripheral edge 41 of the cutter 40. Each insert or cutter 40 is welded or otherwise secured to a seat 25 and 27 and any adjacent insert or cutter 40. Further, mill 10 is strengthened by welding or otherwise securing carbide particles 51 (FIG. 4) to the ledge 26 of the insert support structure 12. In addition, if carbide inserts 40 are worn or break and a leg 11A, 12A is worn away, carbide particles 51 function to cut and extend the life of mill 10. The leg 11A, 12A of each insert support structure 11 can also be strengthened by constructing mill 10 with a metal support that is positioned in the area normally occupied by particles 51. The metal support functions to thicken and strengthen each leg.

While the number of insert support structures 11 to 15 on a mill 10 can vary, five support structures are presently preferred as appearing to be most efficient in drilling a frac plug and/or other material. The ledge 26, 36 of each seat is currently preferably flat, and the ledge 36 of one insert support structure 12 extends past center on mill 10. An odd number of insert support structures 11 to 15 is preferred because an even number of support structures can produce harmonics that produce vibration and shaking and slow the cutting speed of mill 10. In use and testing, dimensional size limitations have, practically speaking, functioned to prevent the use of seven or more seats on mill 10.

A three and three-quarters inch O.D. mill has legs 11A, 12A with outer edges 22, 32 that are currently canted downwardly toward the center 50 at an angle Y (FIG. 2) of twenty-two degrees. The mill is made with two and three-eights API regular pin up. The purpose of such canted edges 22, 32 is to cut material from the outside to the inside of the frac plug or other material being drilled with mill 10. Cutting the frac plug from the outside to the inside of the frac plug is believe to decrease the time required to drill the plug. The downward slope from the outer edge 22, 32 of each leg 11A, 12A, respectively, is indicated by angle Y (FIGS. 2 and 8) and is in the range of eighteen to twenty-six degrees, preferably twenty to twenty-four degrees, more preferably twenty-one to twenty-three degrees, and most preferably twenty-one and a half to twenty-two and a half degrees.

A four and five-eighths inch O.D. mill is made with two and seven-eighths API regular pin up. The downward slope from the outer edge 22, 32 of each leg 11A, 12A, respectively, of the four and five-eighths inch O.D. mill is indicated by angle Y and is in the range of eighteen to twenty-six degrees, preferably twenty to twenty-four degrees, more preferably twenty-one to twenty-three degrees, and most preferably twenty-one and a half to twenty-two and a half degrees. Angle Y is generally quite consistent regardless of the O.D. of the mill. Angle Y is presently twenty-two degrees, and as angle Y moves outside the range of twenty-one and a half to twenty-two and a half degrees the efficiency of the mill noticeably decreases, even though the invention can still be utilized at the angles noted outside the twenty-one and a half to twenty-two and a half range.

A six and one-eighth inch O.D. mill is currently made with two and seven-eighths API regular pin up. The downward slope from the outer edge 22, 32 of each leg 11A, 12A, respectively, of the six and one-eighth inch O.D. mill is indicated by angle Y and is in the range of eighteen to twenty-six degrees, preferably twenty to twenty-four degrees, more preferably twenty-one to twenty-three degrees, and most preferably twenty-one and a half to twenty-two and a half degrees.

The shape and dimension of the carbide inserts or cutters 40 (FIG. 3) can vary as desired, but are presently preferably are generally cylindrical with a three-eighth inch O.D. (outside diameter) at the larger diameter end, a five-sixteens O.D. at the smaller diameter end, and a height typically in the range of three-sixteenths to one-quarter inch. The OD of the larger diameter end of a cutter 40 typically is in the range of one-eighth to three-quarters of an inch, with the smaller diameter end having an O.D. that is somewhat less. After a cutter 40 is affixed to an outer seat 25, 35 or is affixed to a cutter 40 on an inner seat 27, 37, a portion of the peripheral edge 41 extends outwardly and upwardly past the outer edge 22, 32 (FIG. 4) of a leg 11A, 12A.

Cutters 40 are presently preferably braised to a seat 25, 27, 35, 37 with nickel silver solder. The cutters 40 on a first seat pair 25, 27 are staggered, or offset, with respect to the cutters on the next succeeding seat pair 35, 37 (FIG. 6) such that the valleys or low areas between an adjacent pair of cutters on seat pair 25, 27 are offset from the valleys between an adjacent pair of cutters on seat pair 35, 37. This is accomplished by, as is illustrated in FIG. 6, beginning the row of cutters 40 on one seat pair 25, 27 with a full insert 40A and by beginning the row of inserts 40 on the next succeeding seat pair 35, 37 with a half of an insert 40B. Consequently, the inserts 40 along one seat pair 25, 27 include peaks that cut valleys in a frac plug and that leave raised areas intermediate the valleys. The inserts 40 on the next succeeding seat pair 35, 37 function to cut valleys in the raised areas left by the inserts 40 along seat pair 25, 27, and so on. As a result, offsetting the inserts 40 on a second succeeding seat pair 35, 37 from the inserts 40 on a preceding seat pair 25, 27 increases the cutting effectiveness of mill 10.

A mill 10 is presently preferably cast of steel or another desired material, but can be machined, can be assembled by welding together selected parts, or can be otherwise constructed.

One insert support structure 12 (and its associated inserts 40) preferably extends past the center 50 of mill 10 to provide cutting action at the center of mill 10. If each insert support structure met at, and did not extend past, the center 50, a grinding, instead of a cutting, action is produced.

In use of the method of the invention, a drill pipe is provided. The drill pipe has a proximate end and a distal end. The mill 10 is attached to the distal end of the drill pipe. The drill pipe and mill are inserted in the oil or gas well until the mill contacts the frac plug. A slack off weight in the range of 500 to 8,000 pounds is applied, preferably in the range of 2,000 to 3,000 pounds. The slack off weight is the total weight that is permitted to bear against the frac plug. The drill pipe it self may weigh weight 50,000 pounds, but most of this weight is supported by the drilling rig such that only 500 to 8,000 pounds bears against the frac plug. The mill 10 is then rotated at 100 to 500 rpm, preferably 120 to 500 rpm, and most preferably 140 to 500 rpm. The mill 10 can be rotated by rotating the drill pipe or by rotating mill 10 with a motor that is underground with mill 10.

Drilling fluid is pumped into the drill pipe, through the mill, and into the well casing, such that the velocity of fluid moving upwardly along the exterior of the drill pipe is in the range of 285 to 500 feet per minute, preferably 300 to 500 feet per minute. Drilling fluid can, by way of example and not limitation, comprise compressed air or salt water One particular unexpected and unpredicted benefit discovered after the invention was developed is that the utilization of a higher RPM increased the speed with which a mill drills through a frac plug or other material.

Another unexpected and unpredicted benefit discovered after the invention was developed is that reducing the slack off weight to only 500 to 8,000 lbs, preferably 2,000 to 3,000 pounds, significantly increases the speed with which a mill drills through a frac plug or other material.

A further unanticipated benefit discovered after the invention was developed is that increasing the circulation velocity of drilling fluid significantly increases the speed with which a mill drills through a frac plug or other material.

Unless reasons exist to the contrary, judicial notice is taken of the following facts:

1. A dominant long felt trend currently exists in connection with the drilling of frac plugs or other materials and teaches that the typical RPM for a mill being utilized to drill out a frac plug or other materials is sixty to eighty RPM. This trend has occurred over an extended period of time, is followed by a large number of individuals in the pertinent art, and likely can be demonstrated by a significant number of references. A countervailing trend, if any, is believed to be much weaker or to be obfuscated among other trends in the art.
2. A dominant long felt trend currently exists in connection with the drilling of frac plugs or other materials and teaches that the typical slack off weight for a mill being utilized to drill out a frac plug or other materials typically is 10,000 to 12,000 pounds. This trend has occurred over an extended period of time, is followed by a large number of individuals in the pertinent art, and likely can be demonstrated by a significant number of references. A countervailing trend, if any, to utilize lower slack off weights is believed to be much weaker or to be obfuscated among other trends in the art.
3. A dominant long felt trend currently exists in connection with the drilling of frac plugs or other materials and teaches that the upward velocity of drilling fluid is less than two hundred and eighty-five feet per minute. This trend has occurred over an extended period of time, is followed by a large number of individuals in the pertinent art, and likely can be demonstrated by a significant number of references. A countervailing trend, if any, is believed to be much weaker or to be obfuscated among other trends in the art.
4. Common sense judgment requires that valid reasoning justifying such judgment be set forth.
5. A commonly held belief in the oil and gas industry is that a slack off weight in the range of 10,000 to 12,000 lbs ordinarily be utilized when drilling a frac plug or other material.
6. A commonly held belief in the oil and gas industry is that a mill be rotated at sixty to eighty rpm when drilling a frac plug or other material.
7. A commonly held belief in the oil and gas industry is that the velocity of drill fluid from the bottom of a well up ordinarily be less than 285 feet per minute.
8. There is no problem in the frac plug drilling art that provides significant impetus for the development of the invention. Conventional drilling methods have long been accepted.
9. There is no problem in the frac plug drilling art that suggests a readily apparent specific set of solutions, one of which is the invention. Conventional construction methods have long been accepted.
10. There is no problem in the frac plug drilling art that suggests altering conventional slack off weight, mill rpms, and drilling fluid circulation during the drilling of frac plugs or other material. Conventional construction methods have long been accepted.
11. The TSM test, per KSR, can provide helpful insight into evaluating the obviousness of the invention.
12. There is no reason not to use the TSM test in evaluating the obviousness of the invention described and claimed herein.
13. Making something better is a broad, general, long-existing motivation that applies to each invention. Broad, general, long-existing motivations likely provide little significant impetus to produce an invention. For example, in the exercise machine art, one broad, general, long-existing motivation is to make exercise machines versatile, so that more than one exercise can be produced on an exercise machine. This motivation may provide impetus to make obvious modifications to a machine, but provides little significant impetus to produce an invention. If, on the other hand, an exercise machine produces a greater than normal number of injuries, such a problem is more specific and provides strong impetus to improve the machine.
14. Key features of the mill 10 of the invention that improve the efficiency with which the mill cuts include the extension of a bit support structure 12 past the center of the mill, the concavity of the mill, the particular angle of concavity Y, the number of bit support structures, the use of round faced inserts 40, the use of chip breakers in inserts 40, stacking rows of inserts 40 one on top of the other, offsetting a row of insert 40 from the next successive row in the manner depicted in FIG. 6, and rearwardly canting legs 11A, 12A through an angle Z in the manner depicted in FIG. 4. It is a common belief in the oil and gas industry that the use of any one, or a combination of two or more or all of said features do not matter with respect to the drilling efficiency of a mill and will not affect the drilling efficiency of the mill.

Having described the invention in such terms as to enable those of skill in the art to make and practice it, and having described the presently preferred embodiments thereof, I claim:

1. A process to drill through a composite frac plug in an oil well, the composite frac plug including a resin body, and at least one material from a group consisting of a ceramic, cast iron, aluminum, and cloth, the process including the steps of (a) providing a mill including (i) a body having a generally cylindrical circumferential outer surface, and (ii) a cutting face at one end of said body generally normal to said outer surface, and including a center (50) and five spaced apart radially extending insert support structures (11), each of said insert support structures including (iii) an upstanding leg (11A) with an outer edge (22) sloping downwardly and inwardly toward said center (50) at a selected angle (Y) in the range of twenty-one to twenty three degrees and canted back at an angle (Z) in the range of one to three degrees from a vertical axis (X) that is parallel to the axis of rotation of the mill, said leg 11A including a front surface (24) and a rear surface (23), (iv) a first generally flat seat (27) normal to said front surface (24) and sloping downwardly toward said center (50) at said selected angle (Y), (v) a second generally flat seat (25) normal to said front surface (24), stepped upwardly from said first seat (27), and sloping downwardly toward said center (50) at said selected angle (Y), (vi) a plurality of carbide inserts affixed to each of said seats and extending above said ledge, said inserts shaped and dimensioned such that low areas are formed between adjacent carbide inserts affixed to one of said seats, one of said insert support structures extending past said center, and said carbide inserts on said seats of one of said insert support structures being offset from carbide inserts on the next succeeding insert support structure such that said low areas on said one of said insert support structures are offset from said low areas on said next succeeding insert support structure;

(b) providing drill pipe having an exterior, a distal end and a proximate end;

(c) attaching said mill to said distal end of said drill pipe;

(d) inserting said mill and said distal end of said drill pipe in the oil well until said concave cutting face of said mill contacts the top of the composite frac plug;

(e) engaging said proximate end of said drill pipe and (i) rotating said pipe and said mill at one hundred and forty to five hundred rpm, (ii) circulating drilling fluid such that the velocity of said fluid upwardly over said exterior of said drill pipe is in the range of three hundred to four hundred and seventy five feet per minute, and (iii) applying one thousand to three thousand pounds of slack off weight to cut through the frac plug.

* * * * *